US008348361B2

(12) United States Patent
Joerger et al.

(10) Patent No.: US 8,348,361 B2
(45) Date of Patent: Jan. 8, 2013

(54) ADDITIVE DISPENSER DRAWER ASSEMBLY

(75) Inventors: Steve Joerger, Ames, IA (US); Jason Miller, Iowa Falls, IA (US); Stefano DePaoli, Fiume Veneto (IT)

(73) Assignee: Electrolux Home Products, Inc., Cleveland, OH (US)

( * ) Notice: Subject to any disclaimer, the term of this patent is extended or adjusted under 35 U.S.C. 154(b) by 1129 days.

(21) Appl. No.: 12/164,651

(22) Filed: Jun. 30, 2008

(65) Prior Publication Data

US 2009/0322195 A1 Dec. 31, 2009

(51) Int. Cl.

| | |
|---|---|
| ***A47B 88/00*** | (2006.01) |
| ***A47B 77/06*** | (2006.01) |
| ***A47K 1/04*** | (2006.01) |
| ***A47L 19/02*** | (2006.01) |
| ***E03C 1/18*** | (2006.01) |
| ***D06F 29/00*** | (2006.01) |
| ***D06F 35/00*** | (2006.01) |

(52) U.S. Cl. ..... 312/334.18; 312/334.1; 312/228; 68/17 R

(58) Field of Classification Search ..... 312/330.1, 312/228, 229, 408, 334.1, 334.7, 334.16, 312/334.18, 334.21, 334.22; 68/17 R, 12.18, 68/12.14

See application file for complete search history.

(56) References Cited

U.S. PATENT DOCUMENTS

| | | | | | |
|---|---|---|---|---|---|
| 884,526 | A | * | 4/1908 | Ripson et al. | 312/334.12 |
| 2,582,471 | A | * | 1/1952 | West | 312/319.6 |
| 2,757,051 | A | * | 7/1956 | Wilmer et al. | 384/23 |
| 2,759,773 | A | * | 8/1956 | Reitzel et al. | 384/23 |
| 2,793,092 | A | * | 5/1957 | Peterson | 312/246 |
| 2,942,926 | A | * | 6/1960 | Pavelka, Jr. | 312/270.3 |
| 2,985,491 | A | * | 5/1961 | Hayes | 384/19 |
| 2,997,355 | A | * | 8/1961 | Preble | 312/334.18 |
| 3,087,771 | A | * | 4/1963 | Pari | 312/332 |
| 3,099,501 | A | * | 7/1963 | Hillson et al. | 384/19 |
| 3,317,262 | A | * | 5/1967 | Vogt | 312/334.19 |
| 3,460,876 | A | * | 8/1969 | De Boer | 312/246 |
| 3,466,107 | A | * | 9/1969 | Blake | 312/246 |
| 3,521,938 | A | * | 7/1970 | Emaus | 312/246 |
| 3,649,090 | A | * | 3/1972 | Dutot | 384/23 |
| 3,664,716 | A | * | 5/1972 | Johnson | 384/19 |
| 3,722,975 | A | * | 3/1973 | Taylor | 312/334.44 |
| 3,929,387 | A | * | 12/1975 | Grass | 384/19 |
| 4,057,872 | A | * | 11/1977 | Schmidt | 16/29 |
| 4,089,567 | A | * | 5/1978 | Rock et al. | 384/19 |
| 4,162,114 | A | * | 7/1979 | Litchfield et al. | 312/334.1 |

(Continued)

FOREIGN PATENT DOCUMENTS

| | | |
|---|---|---|
| DE | 10061155 | 6/2002 |

(Continued)

OTHER PUBLICATIONS

Excerpt from Rollon Catalog downloaded Jun. 15, 2008 (4 pages).

*Primary Examiner* — Darnell Jayne
*Assistant Examiner* — Kimberley S Wright
(74) *Attorney, Agent, or Firm* — Banner & Witcoff, Ltd.

(57) ABSTRACT

An additive dispenser drawer includes roller assemblies located on opposite sides near a rear portion of the dispenser drawer. Each roller assembly moves within a guide rail attached to a side of a housing. Bearing fixtures are attached to the housing near the front and act upon surfaces of the dispenser drawer.

18 Claims, 14 Drawing Sheets

U.S. PATENT DOCUMENTS 4,227,750 A * 10/1980 Rock et al. ..... 384/18
4,236,773 A * 12/1980 Mertes ..... 312/334.36
4,298,234 A * 11/1981 Litchfield et al. ..... 384/19
4,320,934 A * 3/1982 Rock et al. ..... 312/331
D264,293 S * 5/1982 Litchfield et al. ..... D6/510
D265,036 S * 6/1982 Litchfield et al. ..... D6/510
4,392,696 A * 7/1983 Litchfield et al. ..... 312/333
4,436,989 A * 3/1984 Schuldt ..... 235/22
4,458,964 A * 7/1984 Hardy ..... 312/334.12
4,586,761 A * 5/1986 Shimbara ..... 312/319.1
4,615,572 A * 10/1986 Nelson ..... 312/334.4
4,732,436 A * 3/1988 Nelson ..... 312/334.5
4,786,785 A * 11/1988 Felt ..... 235/7 R
4,852,932 A * 8/1989 Komeya et al. ..... 296/37.9
4,942,329 A * 7/1990 Nelson ..... 312/334.18
5,002,074 A * 3/1991 Kimisawa ..... 131/231
5,018,800 A * 5/1991 Cziptschirsch et al. ... 312/334.7
5,070,556 A * 12/1991 Gloger ..... 5/308
5,366,284 A * 11/1994 Baker et al. ..... 312/404
5,641,217 A * 6/1997 Caruso et al. ..... 312/404
5,730,301 A * 3/1998 Welch et al. ..... 211/41.1
5,787,911 A * 8/1998 Jacobus et al. ..... 134/201
6,467,860 B2 * 10/2002 Remmers ..... 312/334.7
6,626,509 B2 * 9/2003 Remmers ..... 312/334.7
6,826,933 B2 * 12/2004 Merkle et al. ..... 68/17 R
6,848,761 B2 * 2/2005 Salice ..... 312/334.4
6,865,911 B2 3/2005 Bolduan et al.
6,929,305 B2 * 8/2005 Park ..... 296/37.9
7,004,386 B2 * 2/2006 Chien ..... 235/379
7,093,467 B2 * 8/2006 Kim et al. ..... 68/17 R
7,293,815 B2 * 11/2007 Hwang ..... 296/37.12
7,309,115 B2 * 12/2007 Blum et al. ..... 312/334.13
7,578,150 B2 * 8/2009 Zsambeki ..... 68/17 R
7,624,960 B2 * 12/2009 Saenz ..... 248/311.2
7,997,006 B2 * 8/2011 Son et al. ..... 34/381
2004/0263032 A1 12/2004 Cho
2005/0188730 A1 * 9/2005 Zsambeki ..... 68/17 R
2005/0241347 A1 * 11/2005 Cho et al. ..... 68/243
2005/0274156 A1 * 12/2005 Yang ..... 68/17 R
2005/0275236 A1 * 12/2005 Kim ..... 296/37.9
2005/0284194 A1 * 12/2005 Kim et al. ..... 68/17 R
2006/0038422 A1 * 2/2006 Hwang ..... 296/37.1
2006/0162392 A1 7/2006 Kwon et al.
2007/0044517 A1 * 3/2007 Yang et al. ..... 68/17 R
2007/0079637 A1 4/2007 Song
2007/0125134 A1 * 6/2007 Park ..... 68/17 R
2007/0228911 A1 * 10/2007 Kim et al. ..... 312/408
2008/0072631 A1 * 3/2008 Je et al. ..... 68/17 R
2008/0271263 A1 * 11/2008 Bae et al. ..... 8/159
2009/0261697 A1 * 10/2009 Hill et al. ..... 312/333
2010/0275659 A1 * 11/2010 Son et al. ..... 68/17 R

FOREIGN PATENT DOCUMENTS

EP 1449952 8/2004
GB 1211560 11/1970

* cited by examiner

ADDITIVE DISPENSER DRAWER ASSEMBLY

BACKGROUND

Automated washing machines (such as laundry washing machines) often include mechanisms for dispensing additives into a washing chamber (e.g., a rotating drum). Such mechanisms may include dispenser drawers that have chambers or compartments for holding and dispensing different additives, which additives may include detergents, whiteners, fabric softeners, scents, rinse aids, etc. Typically, a user fills one or more dispenser chambers with additives. At selected times during a wash cycle, water is then automatically introduced into the dispenser chamber(s) and mixes with the additive(s). The water/additive mixture then flows out of the dispenser drawer and into the drum or other washing chamber.

An example of a drawer-style additive dispenser is illustrated and described in commonly-owned U.S. Patent Application Publication No. 2004/0011089 (titled "Washing Aid Dispenser and Washing Machine Comprising Said Dispenser"). Access to the drawer by the user is obtained by withdrawing the drawer from an associated dispenser housing provided within the appliance cabinet. Typically, the drawer slides in and out of the dispenser housing along guideways provided on opposite sides of drawer, and on corresponding sides of the cavity that receives the drawer. Examples of drawer-style additive dispensers with frictional slide guides can be seen in U.S. Patent Application Publication No. 2006/0162392, U.S. Patent Application Publication No. 2007/0079637, U.S. Pat. No. 7,093,467, and U.K. Patent No. 1,211,560.

In a modern trend, laundry appliances are taking on a more prominent stylistic role in the home. As part of this trend, greater emphasis is often placed on convenience, user friendliness, and the "look and feel" of laundry appliances. An additive dispenser drawer that operates more smoothly and easily, and which presents a solid feel to a consumer, can provide significant utility. For example, persons shopping for a new washing machine will typically operate readily accessible mechanical features such as a dispenser drawer when examining various makes and models on a retail showroom floor. Consumers will likely consider a smoothly-operating dispenser drawer having a solid feel as indicative of a well designed and well built appliance. Conversely, a consumer may feel that a dispenser drawer operating less smoothly or having excessive side-to-side or vertical looseness ("play") in the drawer mechanism is indicative of poor design or poor workmanship.

One way to improve smoothness of drawer operation and to provide a more solid-feeling mechanism is to include a more sophisticated linear bearing system. Previous efforts to include such bearing systems can be seen in European Patent Application Publication No. 1449952 and in German Patent Application Publication No. 10061155. These and similar efforts have provided incomplete or impractical solutions, however. As with many consumer appliances, minimizing manufacturing costs can be a critical consideration in any design. Many of the known prior art drawer designs utilize a linear bearing system that would be expensive to manufacture, would require enlarging the size of a dispenser drawer, or would otherwise have undesirable consequences.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In at least some embodiments, an additive dispenser drawer includes roller assemblies located on opposite sides near a rear portion of the dispenser drawer. Each roller assembly includes three rollers, with one of those rollers having a rotational axis that lies in a plane offset from a plane containing rotational axes of the other two rollers. The roller assemblies move within guide rails attached to sides of a housing. Bearing fixtures are attached to the housing near the front. In some embodiments, each bearing assembly includes upper and lower rollers acting on corresponding upper and lower surfaces of a rim on the dispenser drawer. In other embodiments, the bearing fixtures are low-friction glides having upper and lower rails that act on the upper and lower surfaces of the dispenser drawer rim. In still other embodiments, the bearing fixtures include rollers inserted through sides of a housing.

BRIEF DESCRIPTION OF THE DRAWINGS

Some embodiments of the present invention are illustrated by way of example, and not by way of limitation, in the figures of the accompanying drawings and in which like reference numerals refer to similar elements.

DETAILED DESCRIPTION

Although various embodiments are described herein using a front-loading clothes washing (or laundry) machine as an example, the invention is not limited to front loading washers. In other embodiments, additive dispensers similar to those described herein are incorporated into top loading washing machines. In still other embodiments, a dispenser similar to those described herein can be incorporated into a combination washer/dryer or into a dryer. Furthermore, the invention is not limited to laundry equipment. Additive dispensers similar to those described herein can also be used in automated dishwashing equipment, as well as in other devices. Indeed, dispensers such as those described herein can be used in devices that perform no washing function.

Figure 1:
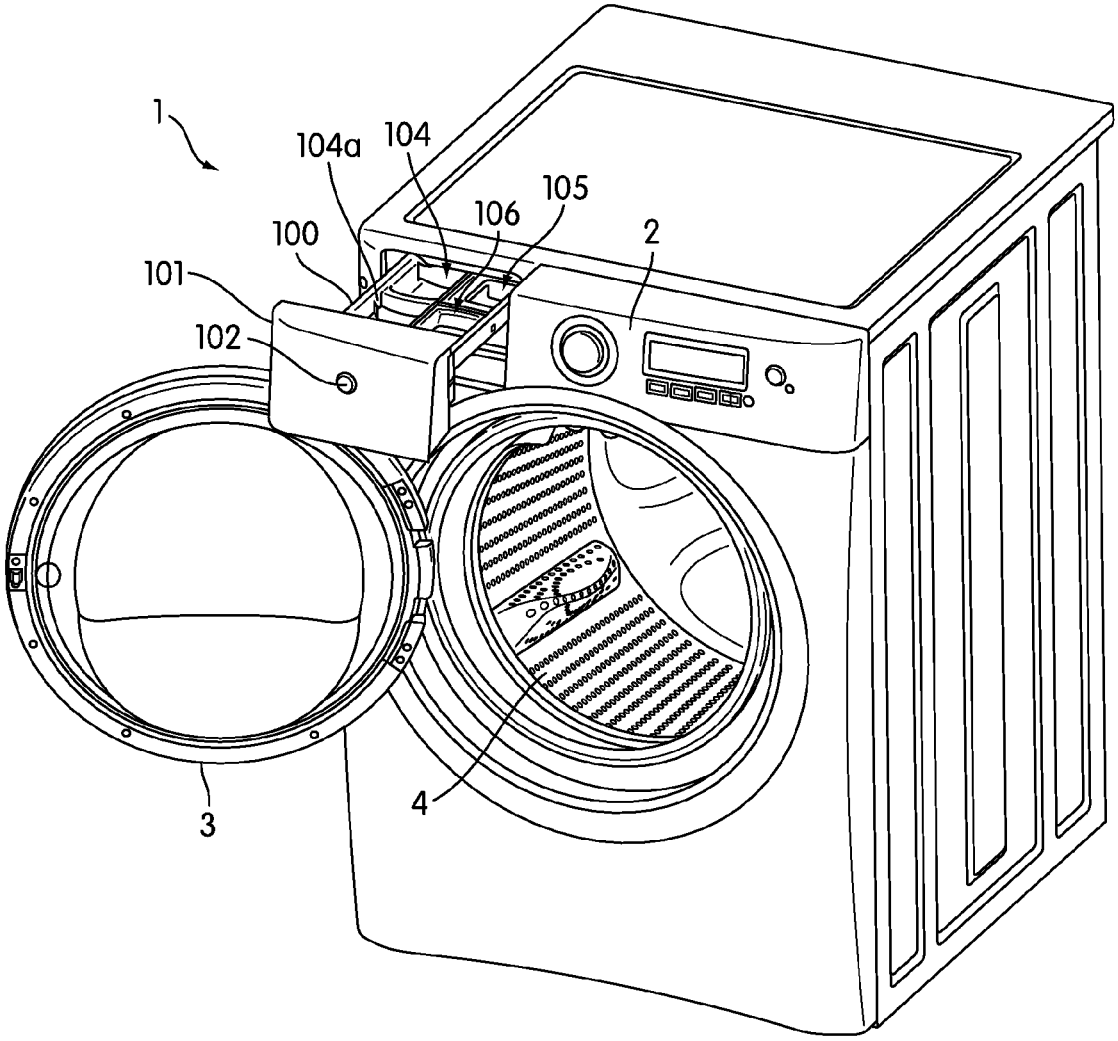
FIG. 1 is a right front perspective view of an automated laundry washing appliance incorporating an additive dispenser drawer assembly according to at least some embodiments.

FIG. 1 is a right front perspective view of an automated laundry washing appliance (machine) 1 incorporating an additive dispenser drawer assembly according to at least some embodiments. Washing machine 1 is of the front-loading, rotating drum variety and includes an additive dispenser drawer 100 that is received within a housing. The housing is not visible in FIG. 1, but is described in more detail below. The assembly of drawer 100 and its housing is installed in the outer cabinet of washing machine 1 in a location adjacent to control panel 2 and above door 3. Drawer 100, which is shown in an open configuration in FIG. 1 (i.e., withdrawn from its housing), also includes a front cover 101 having a latching mechanism to secure drawer 100 within the housing. In operation, a user withdraws drawer 100 from the housing by pressing button 102 to release the latch, thereby allowing drawer 100 be withdrawn from the housing. In some embodiments, a drawer/housing assembly includes a spring or other mechanism to automatically push drawer 100 out of the housing, while in still other embodiments a latching mechanism may be omitted. Drawer 100 may also be completely removed from its housing (and thus from washing machine 1) for cleaning, etc.

Once drawer 100 has been opened, a user may pour laundry additives (e.g., liquid detergent, fabric softener) into one or more of the compartments 104-106 in drawer 100 and push drawer 100 back into the housing. In some embodiments, and as explained below, powdered additives may also be dispensed. During an automated washing cycle, a water dispenser attached to the housing introduces water into compartments 104-106, which water dissolves (or dilutes) the additives and carries same into drum 4.

Figure 2:
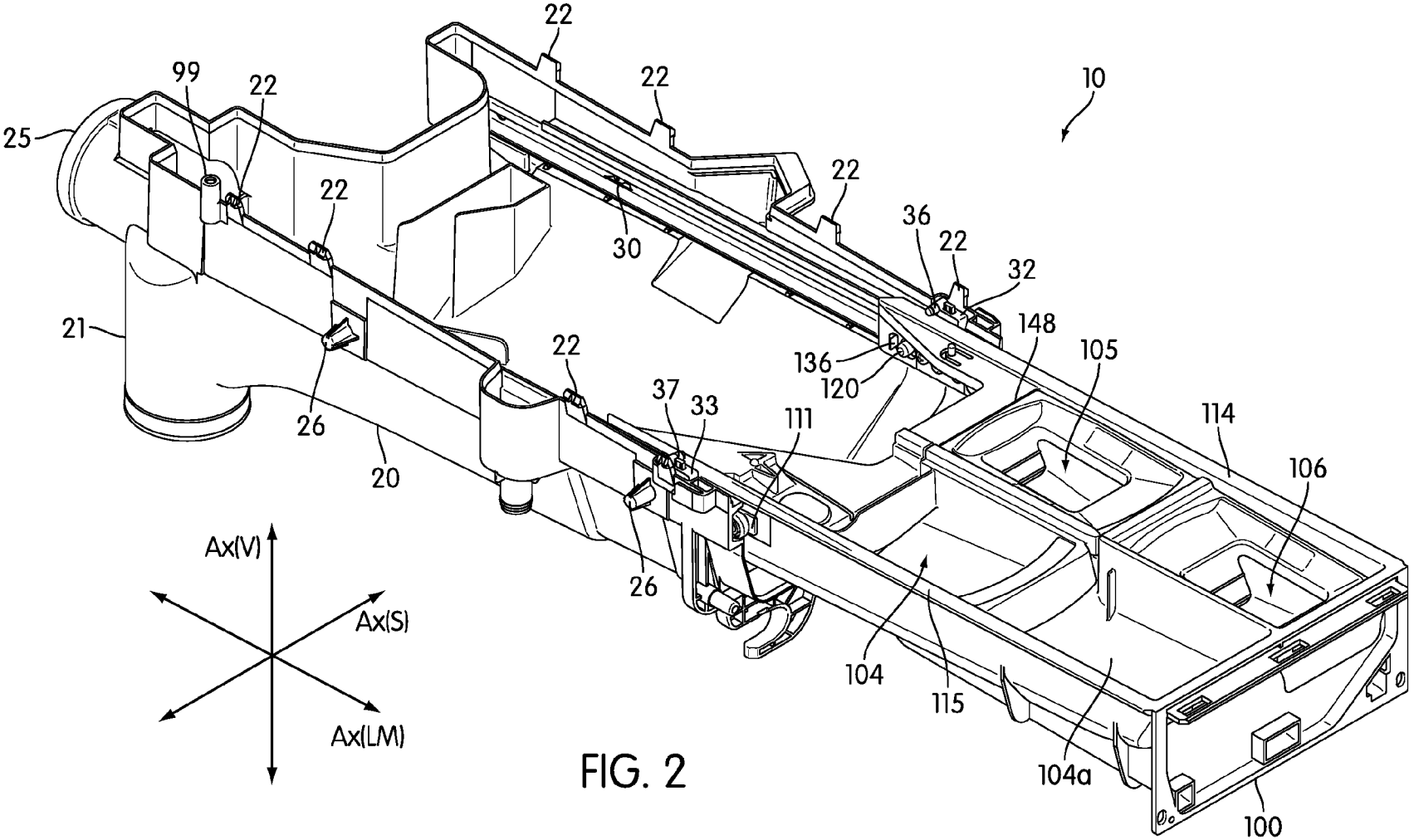
FIG. 2 is a left front perspective view showing an assembly formed by an additive dispenser drawer and its housing.

FIG. 2 is a left front perspective view showing an assembly 10 formed by drawer 100 and its housing 20 removed from washing machine 1. For purposes of explanation, front cover 101 and various other elements not needed for an understanding of the described embodiments have been removed. In the embodiment of FIGS. 2-10, housing 20 is formed as a downwardly-sloping tray having an outlet 21 and an overflow 25 at the rear. A water-distributing mechanism (not shown) attaches to the top of housing 20 using tabs 22. Water flows through the water-distributing mechanism and into one or more of compartments 104, **104*a*, 105 and 106. Additives in these compartments are then carried into the tray of housing 20 and flow out through outlet 21. Compartments 104, 105 and 106** are used to hold liquid additives.

Siphon tubes opening on the lower portion of drawer 100 carry the liquid additives into the tray of housing 20. Compartment **104*a* is used to hold powdered detergent, which flows into the tray of housing 20 through an opening (not shown) when water is added. Housing bosses 26 on housing 20 provide support for screws 43 and 47 (see FIG. 9); boss 99 acts as a mounting post to support assembly 10 when installed in washing machine 1**. In other embodiments, a housing may have a different configuration and/or additives may be extracted from a dispenser drawer in a different manner.

Housing 20 and drawer 100 are configured so as to permit linear movement of drawer 100 relative to housing 20 along a linear movement axis Ax(LM), but so as to constrain drawer 100 from excessive vertical movement (e.g., along axis Ax(V)) and from excessive side-to-side movement (e.g., along axis Ax(S)). As explained in more detail below, this is achieved through a set of roller assemblies moving within guide rails and a set of bearing assemblies attached to housing 20. In the embodiment of FIGS. 2-10, the axis Ax(LM) is generally parallel to guide rail 30 (described below) and to guide rail 31 (not shown in FIG. 2, but also described below), and slightly inclined relative to the horizontal. Axes Ax(S) and Ax(V) are orthogonal to axis Ax(LM). In other embodiments, axis Ax(LM) is not inclined relative to the horizontal.

Figure 3:
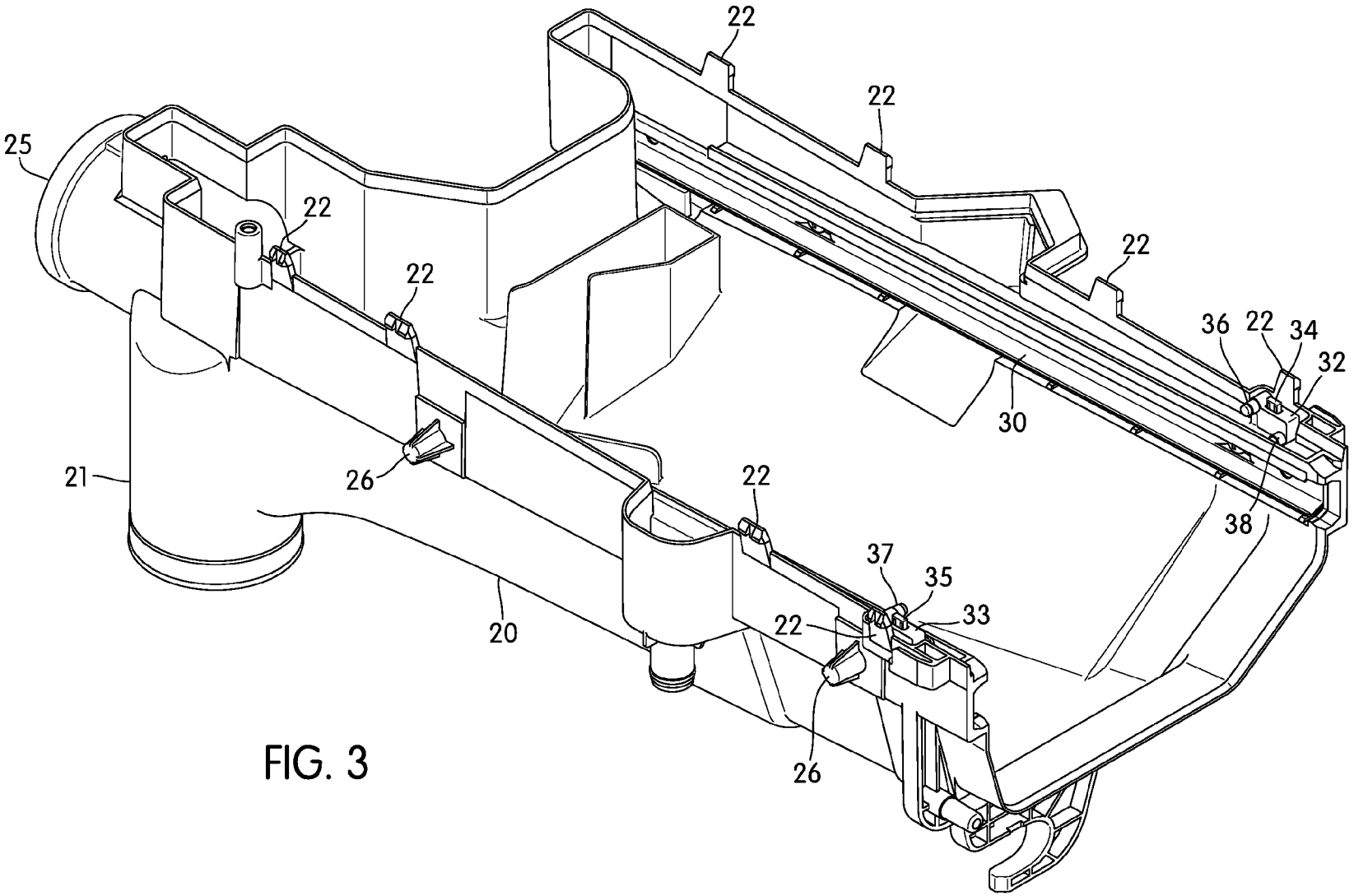
FIG. 3 is a left front perspective view showing the housing of FIG. 2 with the drawer removed.
Figure 4:
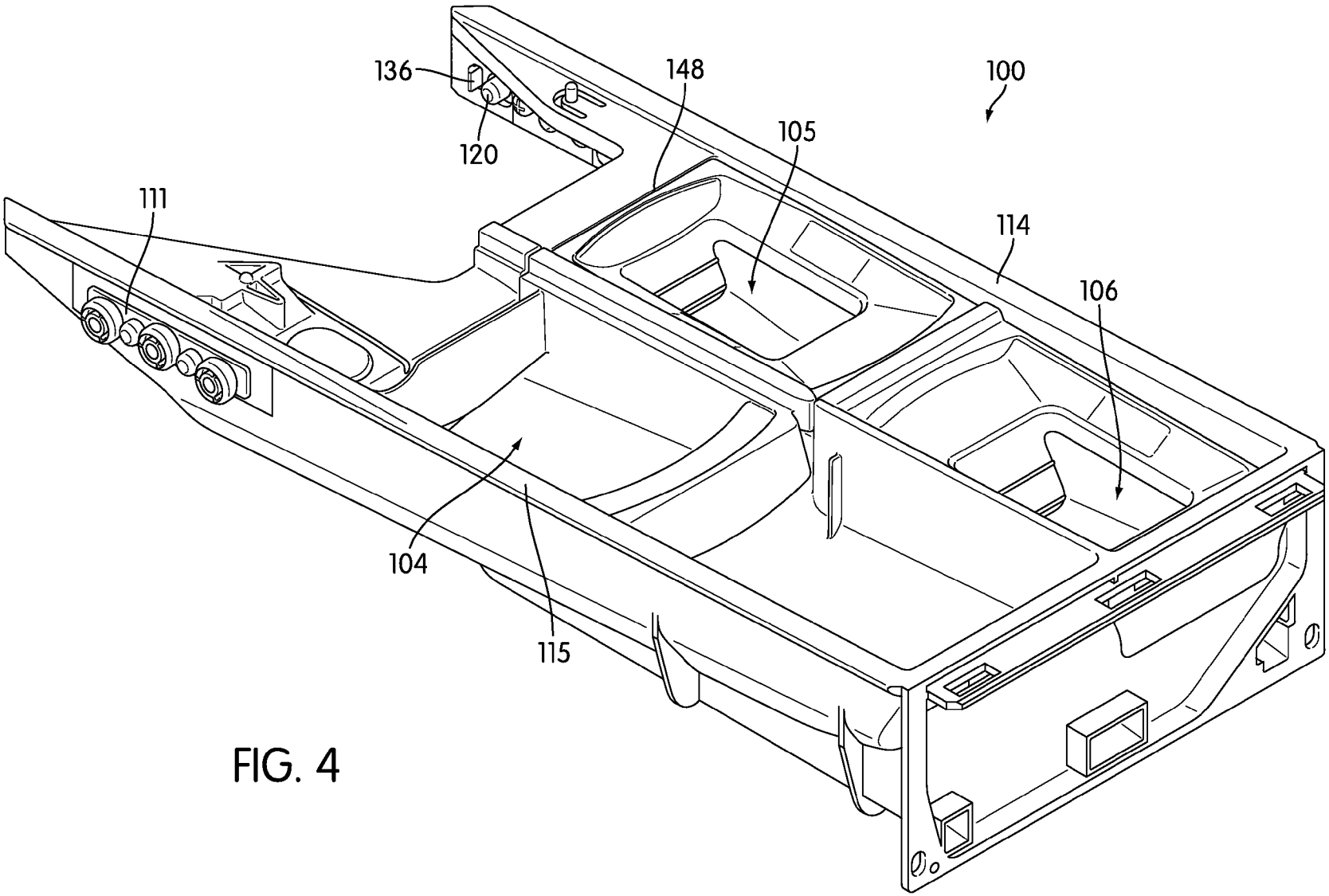
FIG. 4 is a left front perspective view that shows the drawer of FIG. 2 removed from the housing.
Figure 5:
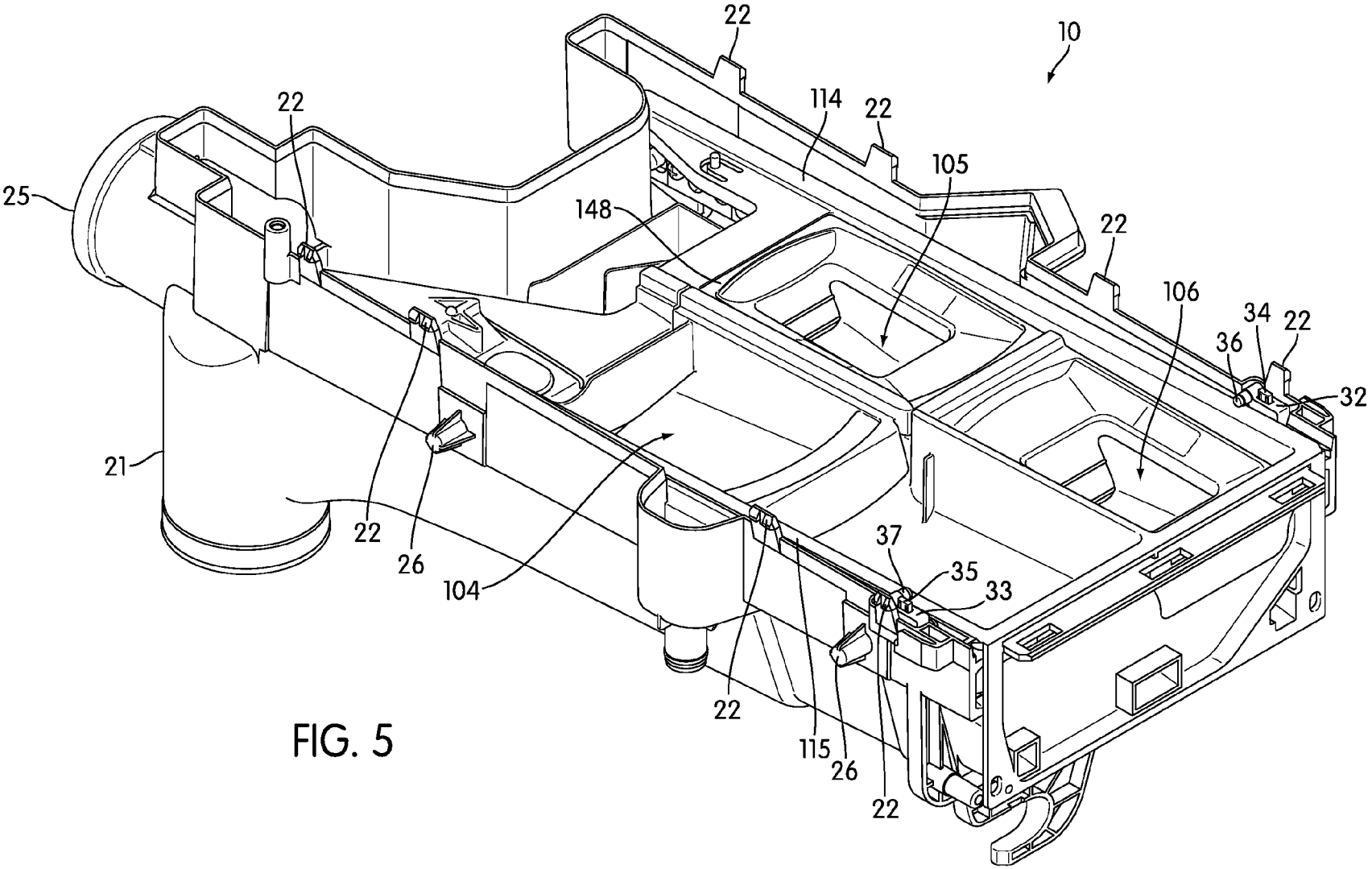
FIG. 5 is a left front perspective view showing the assembly of FIG. 2 in a closed configuration.

FIG. 3 is a left front perspective view showing housing 20 with drawer 100 removed. FIG. 4 is a left front perspective view that shows drawer 100 removed from housing 20. FIG. 5 is a left front perspective view showing assembly 10 with drawer 100 in a closed configuration. As partially seen in FIGS. 2 and 3, housing 20 includes a pair of guide rails 30 and 31. Only the right side guide rail 30 is visible in FIGS. 2 and 3. the left side guide rail 31 can be seen in FIG. 9, which is described below. Moving within guide rails 30 and 31 are roller assemblies 110 and 111 mounted at the rear of drawer 100. Left side roller assembly 111 is partially visible in FIG. 2 and more fully visible in FIG. 4. Only small portions 136 and 120 of right side roller assembly 110 are visible in FIGS. 2 and 4. Right side roller assembly 110 is more fully visible in FIG. 10 (also described below).

Housing 20 further includes a pair of front bearing assemblies 32 and 33 mounted on posts 34 and 35, respectively, near the front of housing 20. Each of front bearing assemblies 32 and 33 includes an upper roller and a lower roller. Upper rollers 36 and 37 of front bearing assemblies 32 and 33, respectively, can be seen in FIGS. 2-5. Lower roller 38 of right front bearing assembly 32 is visible in FIG. 3. Only upper roller 37 of left front bearing assembly 33 can be seen in FIG. 3, although lower roller 39 of left front bearing assembly 33 can be seen in FIG. 9 (described below).

As can be appreciated from FIGS. 2-5, drawer 100 is fully supported by rolling bearings. Rib 114 on the right side of drawer 100 passes between the upper and lower rollers 36 and 38 of right front bearing assembly 32. Rib 115 on the left side of drawer 100 passes between the upper and lower rollers 37 and 39 of left front bearing assembly 33. Left front roller assembly 111 travels within left guide rail 31, and right front roller assembly 110 travels within right guide rail 30. In this manner, and as discussed below, drawer 100 can be opened and closed (i.e., withdrawn from and pushed into housing 20) with reduced friction, thereby providing a smooth operation with minimal play between drawer 100 and housing 20. Because rollers of roller assemblies 110 and 111 move within guide rails 30 and 31, movement of the rear portion of drawer 100 along axes Ax(V) and Ax(S) is limited. Upper rollers 36 and 37 of bearing assemblies 32 and 33, together with inside surfaces of bearing assemblies 32 and 33 that confront edges of ribs 114 and 115, restrict movement of the front portion of drawer 100 along axes Ax(V) and Ax(S).

Figure 6:
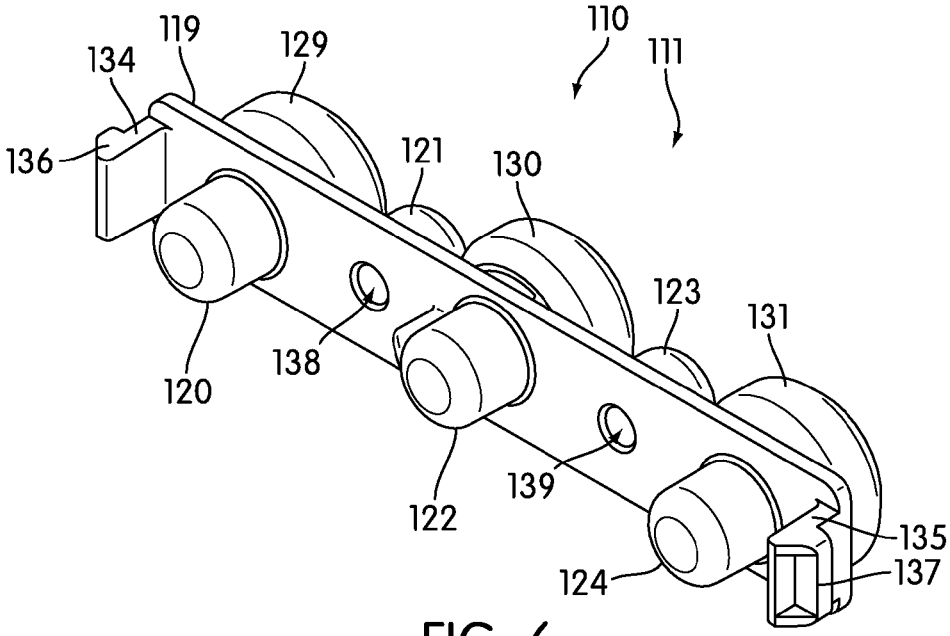
FIG. 6 is a drawer-side perspective view of a roller assembly.
Figure 7:
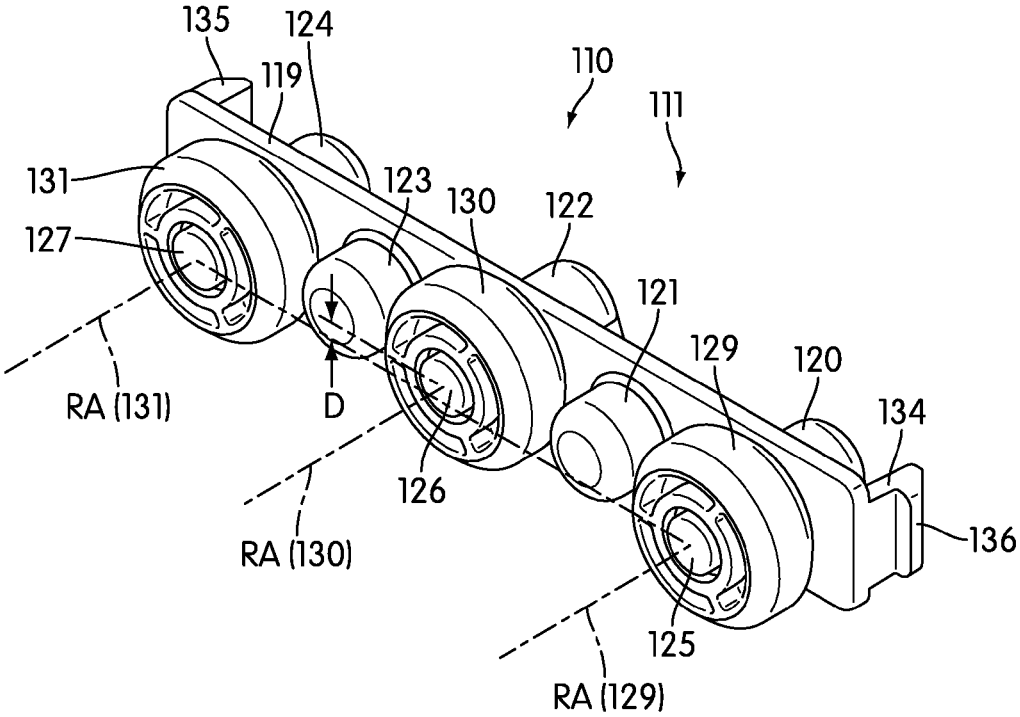
FIG. 7 is a rail-side perspective view of a roller assembly

FIGS. 6 and 7 respectively show drawer-side and rail-side perspective views of right roller assembly 110 and of left roller assembly 111, which roller assemblies are identical. A roller assembly includes a molded plastic frame 119 having five bosses 120, 121, 122, 123 and 124. Bosses 120, 122 and 124 support shafts 125, 126 and 127, respectively. Roller 129 rotates about shaft 125, roller 130 rotates about shaft 126, and roller 131 rotates about shaft 127. In some embodiments, rollers 129, 130 and 131 include internal ball bearings (not shown) to provide smoother rotation about shafts 125, 126 and 127. In some embodiments, frame 119 and rollers 129, 130 and 131 are molded from materials such as Acetal (also known as polyoxymethylene, or POM). Shafts 125, 126 and 127 can be formed from stainless steel (e.g., AISI 430) or other appropriate metal and press fit into holes formed in bosses 120, 122 and 124.

As seen in FIG. 7, the axis of rotation for roller 130 (RA(130)) is slightly higher (by a distance D) than the axes of rotation for rollers 129 and 131 (RA(129) and RA(131)). Stated differently, axis RA(130) lies in a plane that is slightly offset (by the distance D) from a plane in which axes RA(129) and RA(131) lie. Frame 119 includes tabs 134 and 135 having retainers 136 and 137 formed thereon. Bosses 121 and 123 have though holes 138 and 139 formed therein. The significance of these various features is discussed below.

In the embodiment of FIGS. 2-10, ribs 114 and 115 are also the upper rims of drawer 100. Although ribs or other structures for interaction with housing-mounted front bearing assemblies could be formed elsewhere on drawer 100, utilization of ribs/rims 114 and 115 offers several advantages. Additional stability can be obtained if the front bearing assemblies act against portions of drawer 100 that are vertically displaced from roller assemblies 110 and 111. Moreover, ribs 114 and 115 are, in at least some embodiments, desired for other purposes (e.g., to provide a broader lip to catch drips from additives poured into compartments 104-106, for aesthetic design purposes). Utilization of ribs 114 and 115 as the structures to be acted upon by the front bearing assemblies avoids the need for creating additional structures on drawer 100. Utilizing ribs 114 and 115 as bearing surfaces has disadvantages, however. As discussed above, water dispensing structures are attached to housing 20. Those water dispensing structures are located immediately above drawer 100 (at least when drawer 100 is in a closed configuration). There is thus very little room for any portion of a bearing assembly above the upper surfaces of rims 114 and 115. Bearing assemblies 32 and 33 are configured to act upon rims 114 and 115 and to fit within the limited available space.

Figure 8:
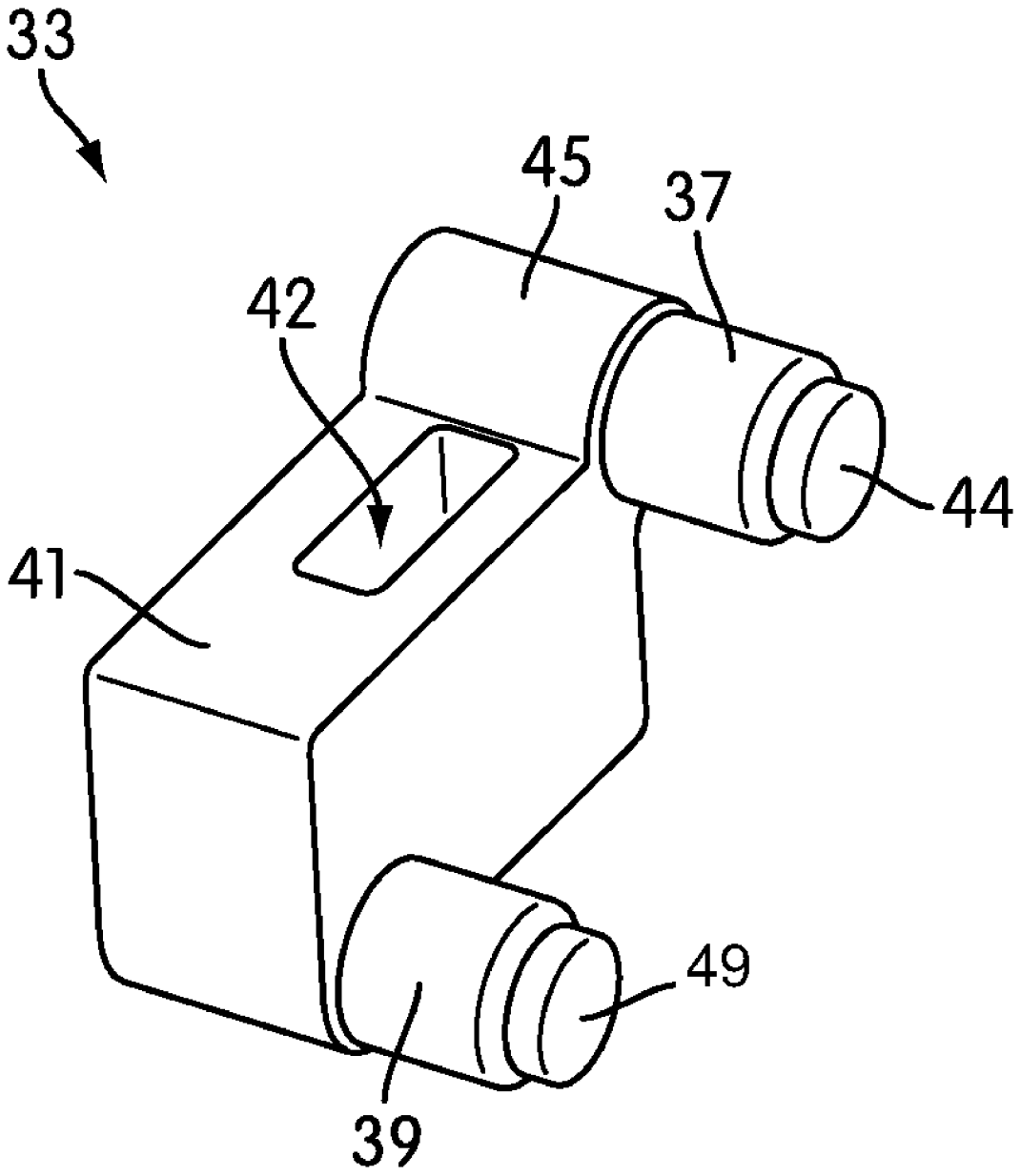
FIG. 8 is a right front perspective view of a front bearing assembly.

FIG. 8 is a right front perspective view of left front bearing assembly 33, with right front bearing assembly 32 being a mirror image thereof. Left front bearing assembly 33 has a body portion 41 having a slot 42 passing all the way through. A first axle pin 49 is pressed into a hole (not shown) formed in the lower front quadrant of body portion 41, and a second axle pin 44 is press fit into a hole (also not shown) formed in boss 45 located on the upper rear portion of body portion 41. Roller 39 rotates freely about pin 49 and roller 37 rotates freely about pin 44. In at least some embodiments, body portion 41 and rollers 37 and 39 are molded from POM, Acetal with silicone and Teflon, or other appropriate material, with pins 49 and 44 formed from stainless steel (e.g., AISI 430).

Figure 9:
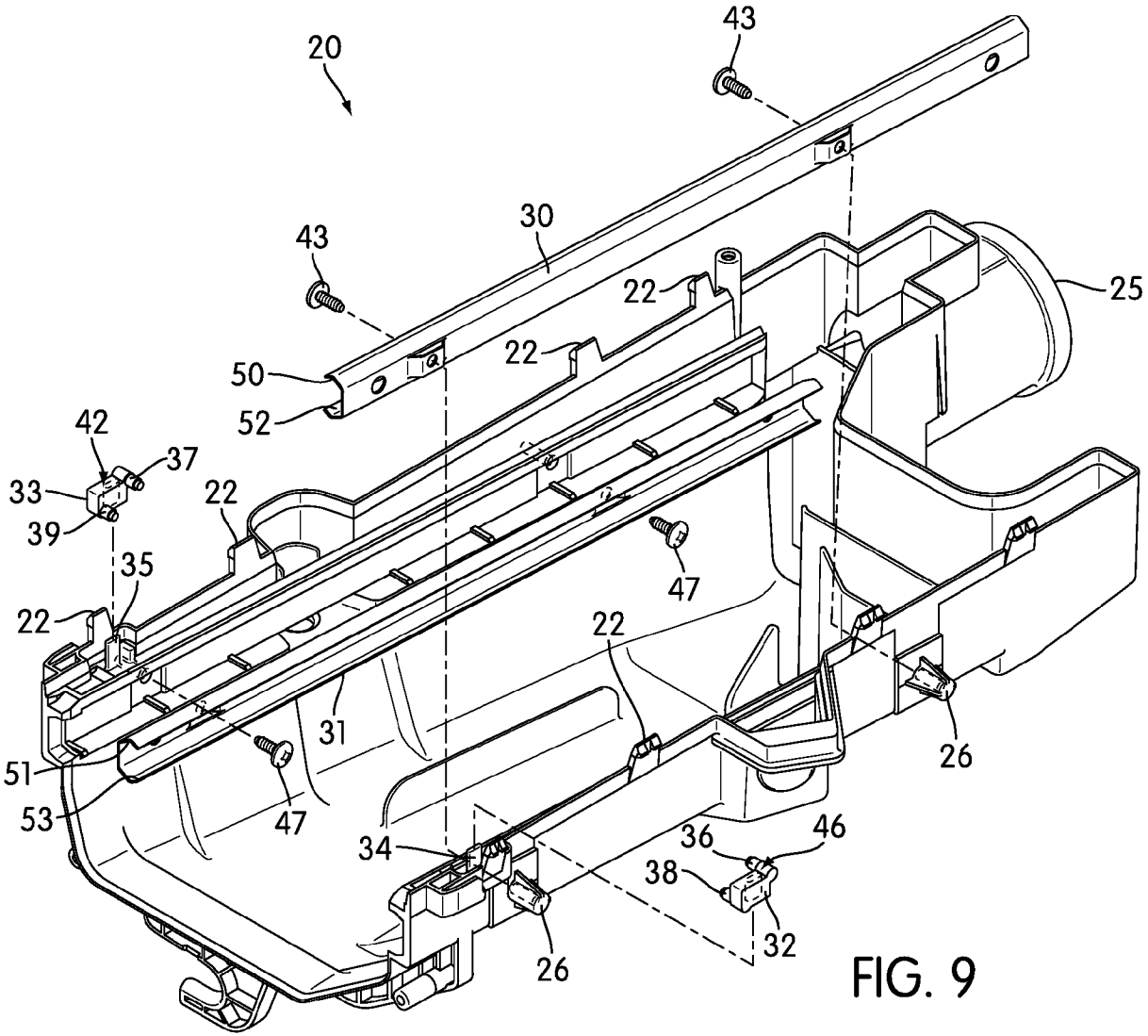
FIG. 9 is a right front perspective "exploded" view of the housing of FIGS. 2, 3 and 5.
Figure 10:
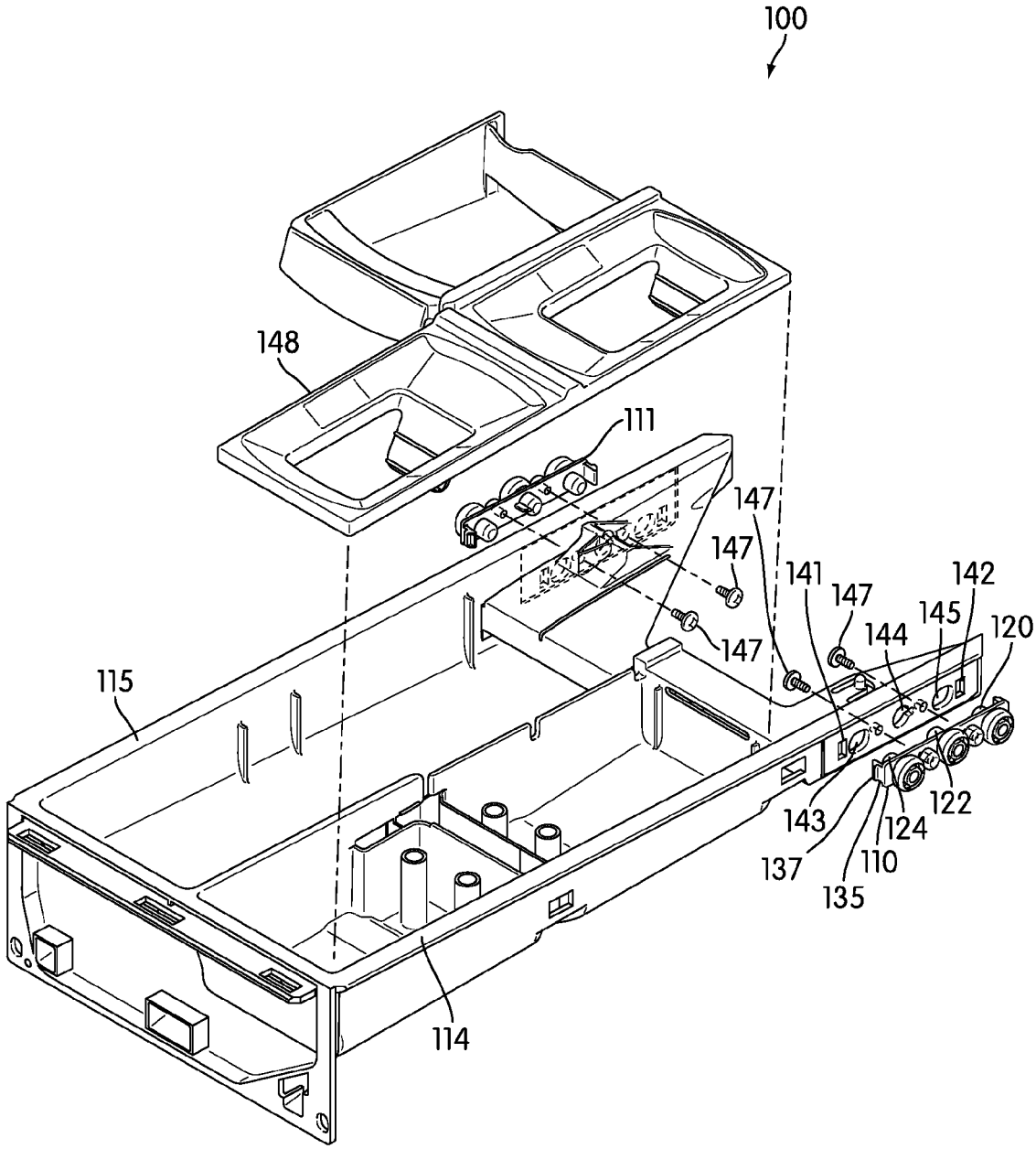
FIG. 10 is a right front perspective "exploded" view of the drawer of FIGS. 2, 4 and 5.

FIG. 9 is a right front perspective "exploded" view of housing 20. Right front bearing assembly 32 is installed over tab 34 using a slot 46 formed in the body of right front bearing assembly 32. Left front bearing assembly 33 is similarly installed over tab 35 using slot 42. Rails 30 and 31 are installed with screws 47. FIG. 10 is a right front perspective "exploded" view of drawer 100. Roller assemblies 110 and 111 are attached at the rear of drawer 100. Tabs 135 and 134 of frame 119 (of roller assembly 110) fit into slots 141 and 142 formed in the right side of drawer 100, with bosses 124, 122 and 120 fitting into holes 143, 144 and 145. Retainers 136 and 137 hold frame 119 in place once pushed through slots 142 and 141. Screws 147 are then screwed from the inside of drawer 100 into holes 138 and 139 formed in bosses 121 and 123. Left front roller assembly 111 is installed in a similar manner. Cover 148 is installed onto the top of drawer 100. Other components of drawer 100 that are not pertinent to the present discussion have been omitted from FIG. 10.

As can be appreciated by a person of ordinary skill in the art, the dispenser drawer and housing arrangement shown in FIGS. 2-10 offers various advantages when drawer 100 is opened and closed. Guide rails 30 and 31 have upper interior surfaces 50 and 51, respectively and lower interior surfaces 52 and 53, respectively. The two lower rollers 129 and 131 of roller assembly 110 contact lower internal surface 52 of rail 30 and upper roller 130 contacts upper internal surface 50 of rail 30. The upper and lower rollers of roller assembly 111 similarly contact upper and lower surfaces 51 and 53 of rail 31. Because of the vertical displacement between the rotational axes of the upper and lower rollers of roller assemblies 110 and 111, all three rollers on each roller assembly can roll when drawer 100 is moved within housing 20. The rolling action of the rollers provides smooth drawer movement, and the three points of contact of each roller assembly within its corresponding guide rail provide vertical and side-to-side stability for drawer 100 within housing 20. The rolling contact of upper and lower rollers 36 and 38 on the upper and lower surfaces of rib 114, together with the rolling contact of upper and lower rollers 37 and 39 on the upper and lower surfaces of rib 115, provide further stability and smooth drawer motion.

The bearing system described in connection with FIGS. 2-10 also offers manufacturing advantages. Frames and rollers for roller assemblies 110 and 111 can be molded to relatively precise dimensions at relatively low cost. Because roller assemblies 110 and 111 are independent subassemblies, they can be separately manufactured. However, roller assemblies 110 and 111 can also be easily installed into preformed holes in drawer 100 and require minimal space. The cooperation of the bosses and tabs on the roller assemblies with corresponding holes and slots in drawer 100 permit accurate and easy placement of the roller assemblies in the correct positions. In other embodiments, roller assemblies can have different shapes that cooperate with different types of three-dimensional features in a drawer body so as to achieve a similar positioning effect. For example, a roller assembly could have square (or other shaped) bosses that correspond to mating holes (or indentations) in dispenser drawer body, a dispenser drawer body could have a cutout or indentation corresponding to the entire frame of a roller assembly, a dispenser drawer body could have protrusions that correspond to mating holes or indentations in a roller assembly frame, etc.

Similarly, front bearing assemblies 32 and 33 are independent subassemblies that can be separately manufactured at relatively low cost and to relatively precise dimensions, and can be easily installed. The cooperation of tabs 34 and 35 with slots 46 and 42 similarly permits accurate and easy placement of the bearing assemblies in the correct locations. In other embodiments, bearing assemblies can have different shapes that cooperate with different types of three-dimensional features of a housing so as to achieve a similar positioning effect.

Figure 11:
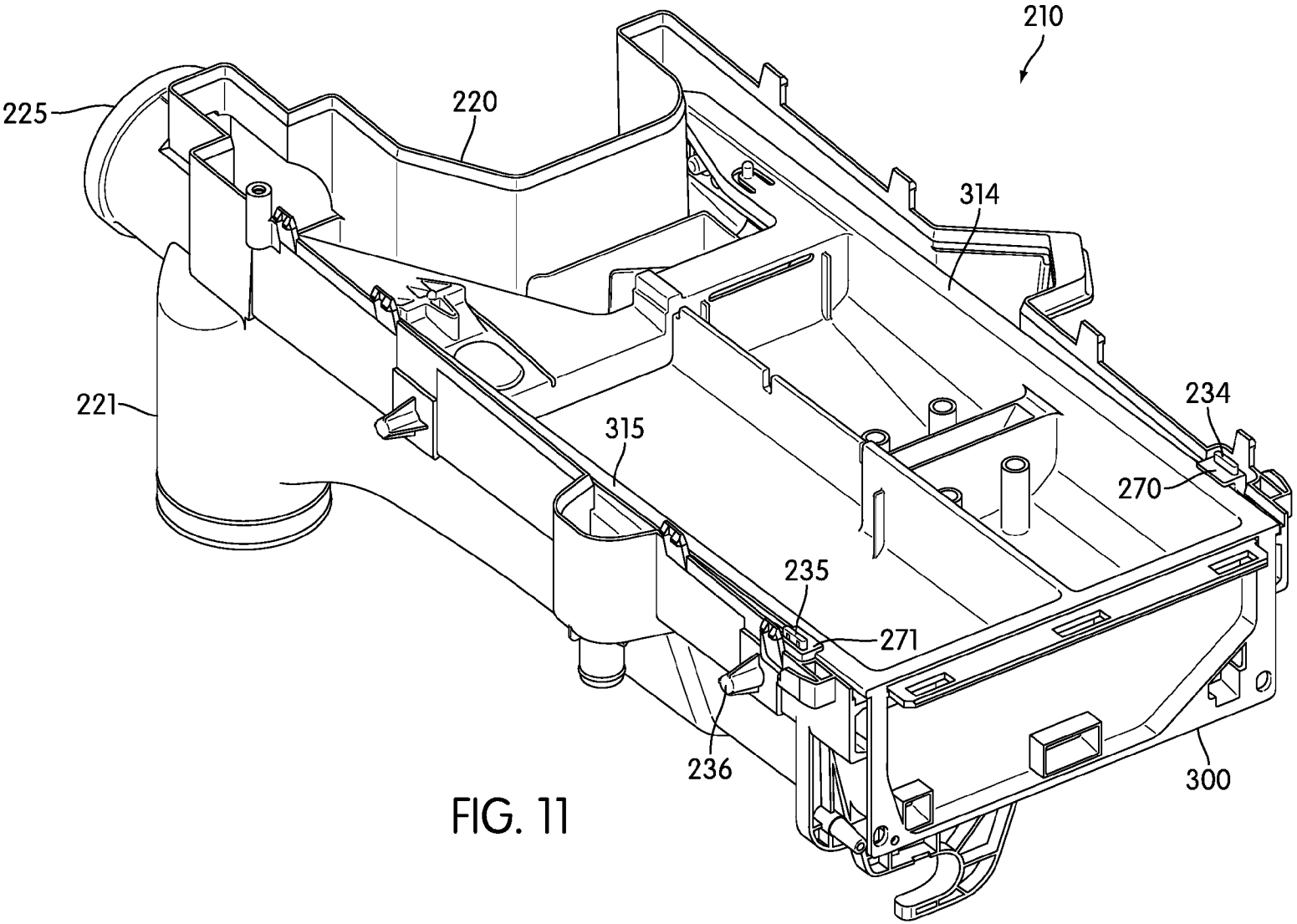
FIG. 11 is a left front perspective view of an assembly of a drawer and housing according to a another embodiment.
Figure 12:
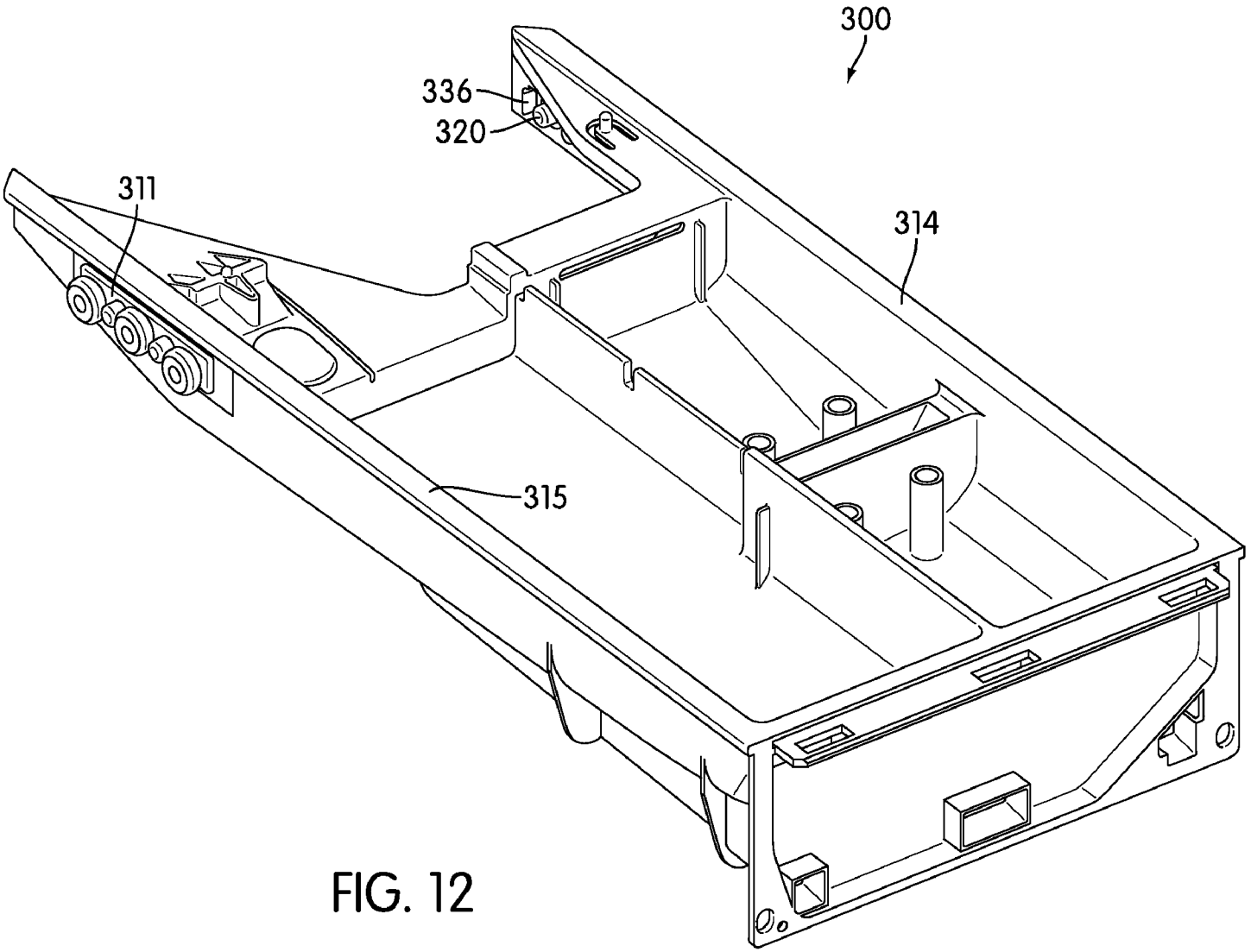
FIG. 12 is a left front perspective view of the drawer of FIG. 11 removed from the housing.
Figure 13:
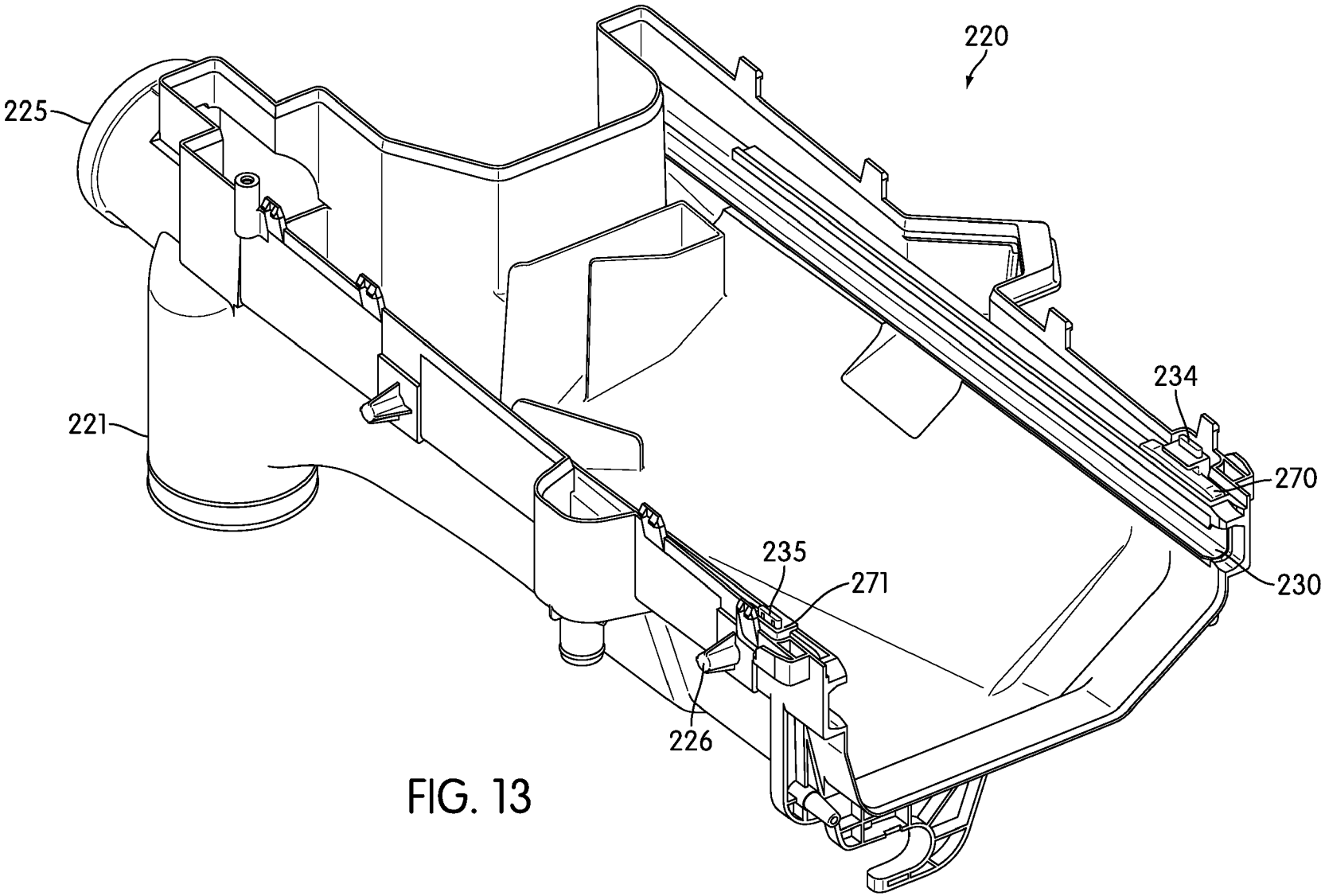
FIG. 13 is a left front perspective view of the housing of FIG. 11 with the drawer removed.

FIG. 11 is a left front perspective view of an assembly 210 of a drawer 300 and housing 220 according to another embodiment. FIG. 12 is a left front perspective view of drawer 300 removed from housing 220, and FIG. 13 is a left front perspective view of housing 220 with drawer 300 removed. The embodiment of FIGS. 11-13 is almost completely identical to the embodiment of FIGS. 2-10, with the only difference being replacement of front bearing assemblies 32 and 33 with low-friction glides 270 and 271. A drawer cover similar to cover 148 is not shown in FIGS. 11-13. Features of the embodiment of FIGS. 11-13 that correspond to features of FIGS. 2-10 have been given similar reference numbers, but are offset by 200 (e.g., roller assembly 111 of FIG. 4 is identical to roller assembly 311 of FIG. 12).

Figure 14:
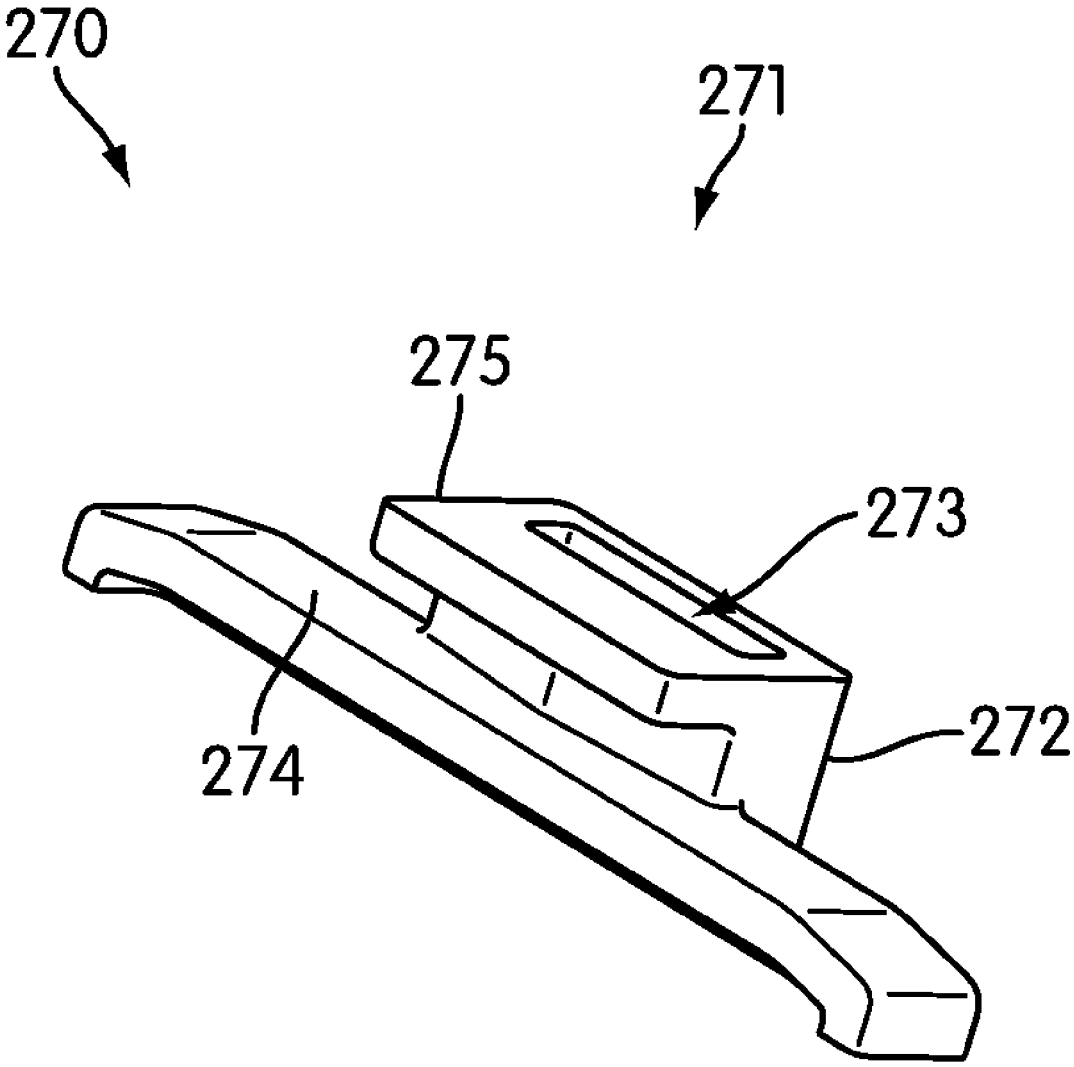
FIG. 14 is an enlarged left front perspective view of a low-friction glide from FIG. 11.

FIG. 14 is an enlarged left front perspective view of low-friction glides 270 and 271, which are identical. Glides 270 and 271 are molded from a low-friction polymer material such as POM. Each of glides 270 and 271 has a central main body portion 272 having a slot 273 formed all the way through, a lower rail 274, and an upper rail 275. Glide 270 is installed in housing 220 over tab 234 using slot 273, in a manner similar that in which tab 34 is passed into slot 36 when installing right front bearing 32 (see FIG. 9). Glide 271 is installed in a similar manner over tab 235. Rib 314 of drawer 300 slides in a slot formed between lower rail 274 and upper rail 275 of glide 270. Similarly, rib 315 slides in a slot formed between the upper and lower rails of glide 271. As with front bearing assemblies 32 and 33 of the embodiment of FIGS. 2-10, glides 270 and 271 provide stability and smooth drawer motion, are economical to manufacture, and require little vertical space to install in housing 220.

Figure 15:
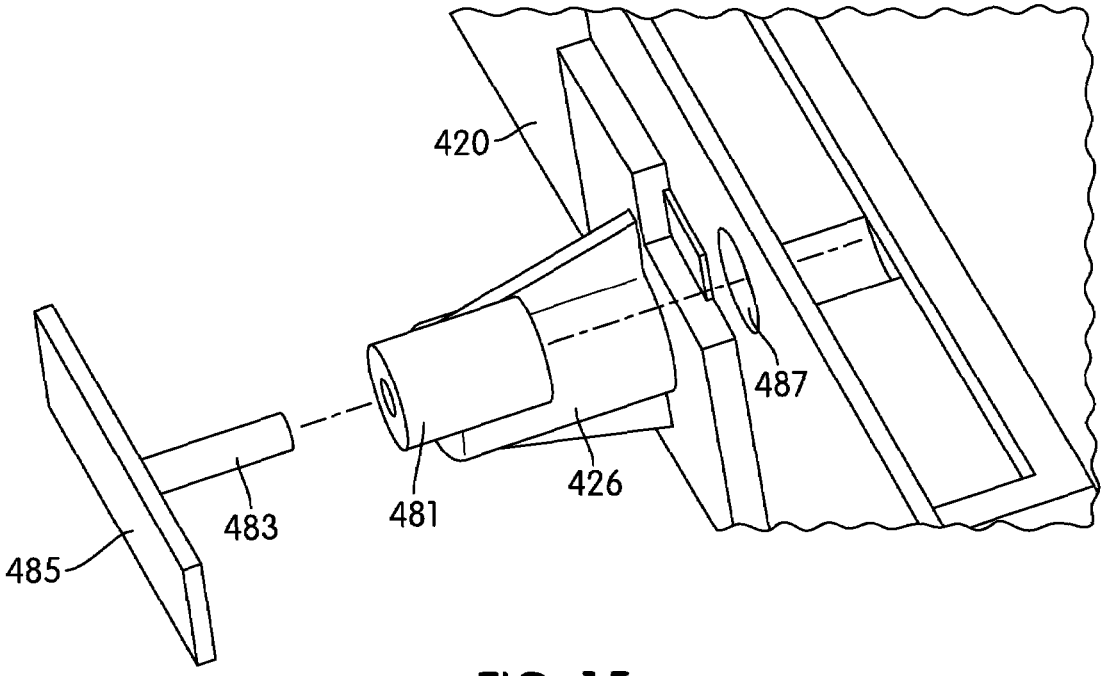
FIG. 15 is an "exploded" view of a front bearing fixture according to another embodiment.
Figure 16:
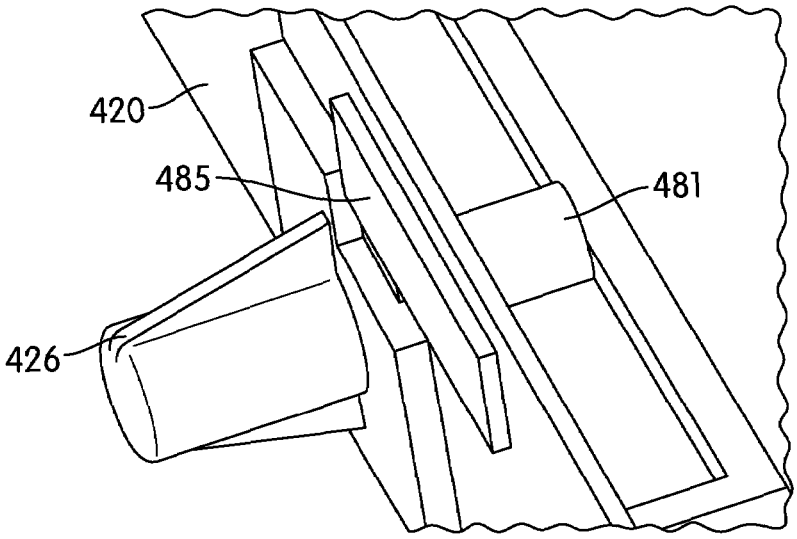
FIG. 16 is a view of the fixture of FIG. 15 after assembly and installation.

FIGS. 15 and 16 show a portion of a housing 420 according to yet another embodiment. Housing 420 is also similar to housing 20 of the embodiment of FIGS. 2-10, except that each of front bearing assemblies 32 and 33 is replaced with a single-roller bearing. For example, and as seen in FIG. 15 (an "exploded" view), a roller 481 is rotatably mounted on a shaft 483 extending from a bearing support 485. Roller 481 is inserted through a hole 487 in the upper edge of the left side of housing 420, and the inside surface of bearing support 485 is then glued or otherwise affixed to the outside surface of housing 420. Boss 426 corresponds to the front left boss 26 of housing 20 (see FIG. 3), thus further indicating the location of roller 481 relative to other portions of housing 420 not seen in FIGS. 15 and 16. A roller similar to roller 481 is installed on the opposite side of housing 420 in a similar manner.

Although the embodiment of FIGS. 15 and 16 offers less vertical stability in the forward portion of the drawer housing, a smooth movement of the drawer within the housing is still provided.

Although the foregoing description provides details for three types of front bearing fixtures that can be coupled to a dispenser drawer housing, other types of bearing fixtures could be used. For example, a housing-mounted bearing fixture could combine features of a bearing assembly (such as bearing assemblies 32 and 33) with features of a low-friction glide (such as glides 270 and 271) by having a lower roller and an upper glide rail (or vice versa).

Numerous characteristics, advantages and embodiments of the invention have been described in detail in the foregoing description with reference to the accompanying drawings. However, the above description and drawings are illustrative only. The invention is not limited to the illustrated embodiments, and all embodiments of the invention need not necessarily achieve all of the advantages or purposes, or possess all characteristics, identified herein. Various changes and modifications may be effected by one skilled in the art without departing from the scope or spirit of the invention. The elements and uses of the above-described embodiments can be rearranged and combined in manners other than specifically described above, with any and all permutations within the scope of the invention. As used herein (including the claims), "coupled" includes two components that are attached by one or more intermediate components.

The invention claimed is:

1. A dispenser drawer and housing assembly, comprising:

a housing including a first rail with first and second internal surfaces, a second rail with first and second internal surfaces, a first bearing fixture with first and second bearings, and a second bearing fixture with first and second bearings; and a dispenser drawer configured to contain one or more additives, to release the one or more additives upon introduction of liquid into the dispenser drawer, and for linear movement within the housing, the dispenser drawer including a first roller group including first and second rollers substantially inside the first rail and respectively in contact with the first and second internal surfaces of the first rail, wherein the first roller group comprises a third roller in contact with the first internal surface of the first rail, and wherein axes of rotation of the first and third rollers of the first roller group are in a first plane, an axis of rotation of the second roller of the first roller group is in a second plane, and the first plane is offset from the second plane, a second roller group including first and second rollers substantially inside the second rail and respectively in contact with the first and second internal surfaces of the second rail, a first surface generally parallel to a direction of the linear movement and in contact with the first bearing of the first bearing fixture, a second surface generally parallel to the direction of the linear movement and in contact with the second bearing of the first bearing fixture, a third surface generally parallel to the direction of the linear movement and in contact with the first bearing of the second bearing fixture, and a fourth surface generally parallel to the direction of the linear movement and in contact with the second bearing of the second bearing fixture.

2. The dispenser drawer and housing assembly of claim 1, wherein the first bearing fixture comprises a low friction glide bearing.

3. The dispenser drawer and housing assembly of claim 2, wherein the first and second surfaces are upper and lower surfaces of a rib extending from the dispenser drawer, wherein the first bearing of the first bearing fixture comprises a rail having a stationary surface in contact with the upper surface, and wherein the second bearing of the first bearing fixture comprises a rail having a stationary surface in contact with the lower surface.

4. The dispenser drawer and housing assembly of claim 1, wherein the first bearing fixture comprises at least one roller.

5. The dispenser drawer and housing assembly of claim 1, wherein the first bearing of the first bearing fixture comprises a first roller, and wherein the second bearing of the first bearing fixture comprises a second roller.

6. The dispenser drawer and housing assembly of claim 1, wherein each of the first and second roller groups comprises a frame, the second roller group comprises a third roller, the dispenser drawer includes apertures to receive and position the roller group frames, the first bearing of the first bearing fixture comprises a first roller, the second bearing of the first bearing fixture comprises a second roller, the first bearing of the second bearing fixture comprises a third roller, the second bearing of the second bearing fixture comprises a fourth roller, and each of the first and second bearing fixtures comprises means for attachment to a cooperating means for attachment on the housing.

7. The dispenser drawer and housing assembly of claim 1, wherein each of the first and second roller groups comprises a frame, the second roller group comprises a third roller, each of the first and second roller groups is an independent subassembly coupled to the dispenser drawer, and each of the first and second bearing fixtures is an independent subassembly coupled to the housing.

8. The dispenser drawer and housing assembly of claim 1, wherein the housing defines a space within which the dispenser drawer is configured to linearly move, and the first and second bearing fixtures are located on opposing sides of the space within which the dispenser drawer is configured to linearly move.

9. The dispenser drawer and housing assembly of claim 8, wherein the first bearing of the first bearing fixture comprises a first rail, the second bearing of the first bearing fixture comprises a second rail, the first rail and the second rail define an inter-rail space that opens toward the space within which the dispenser drawer is configured to linearly move.

10. The dispenser drawer and housing assembly of claim 1, wherein the dispenser drawer includes a first lateral side and an opposing second lateral side, the first and second dispenser drawer surfaces are located on the first lateral side, and the third and fourth dispenser drawer surfaces are located on the second lateral side.

11. The dispenser drawer and housing assembly of claim 10, wherein the first and second dispenser drawer surfaces are located on a first element extending from a main portion of the dispenser drawer, the third and fourth dispenser drawer surfaces are located on a second element extending from the main portion of the dispenser drawer, and the first element is different from the second element.

12. An apparatus, comprising:

a dispenser drawer having at least one compartment configured to retain an additive and to dispense the additive upon introduction of a liquid into the compartment; and a roller subassembly coupled to a main body portion of the dispenser drawer, the roller subassembly having a one-piece molded frame and including first, second and third rollers coupled to the frame, wherein the first and second rollers have axes of rotation in a first plane and the third roller has an axis of rotation in a second plane offset from the first plane, and the dispenser drawer main body portion includes at least one three dimensional feature configured to receive and position the roller subassembly;

a housing configured to receive the dispenser drawer, to permit linear movement of the dispenser drawer within the housing, and to receive liquid and additive from the dispenser drawer and channel the received liquid and additive to an outlet; and a guide rail coupled to the housing and having first and second internal surfaces, wherein the first and second rollers contact and are rollable along the first internal surface and the third roller contacts and is rollable along the second internal surface.

13. The apparatus of claim 12, wherein the roller subassembly includes a plurality of protrusions on a side opposite to a side on which the first, second and third rollers are located, and the at least one three dimensional feature comprises apertures that correspond to the plurality of protrusions.

14. The dispenser drawer and housing assembly of claim 12, wherein the rotational axes of the first, second and third rollers remain fixed relative to one another.

15. The apparatus of claim 12, comprising a fourth roller coupled to a first side of the housing and contacting a first lower surface of the dispenser drawer; and a fifth roller coupled to a second side of the housing and contacting a second lower surface of the dispenser drawer.

16. The apparatus of claim 12, further comprising a low friction glide bearing coupled to the housing, and wherein the glide bearing includes upper and lower rails in contact with upper and lower surfaces of a rib on the dispenser drawer.

17. The apparatus of claim 16, wherein the glide bearing is a molded integral piece.

18. The apparatus of claim 12, further comprising a bearing fixture subassembly coupled to the housing, wherein the bearing fixture subassembly includes a one-piece main body portion, the bearing fixture subassembly further includes at least two rollers coupled to the one-piece main body portion, the at least two rollers vertically restrain the dispenser drawer, and the main body portion includes an opening through which is inserted a corresponding projection of the housing.

* * * * *